United States Patent [19]

Kaspar et al.

[11] 4,412,608

[45] Nov. 1, 1983

[54] COIN DISPENSING MACHINE FOR NON-FERROUS BEVERAGE CANS

[75] Inventors: Arthur H. Kaspar; Johnny J. Valis; Weldon J. Aschenbeck, all of Shiner, Tex.; Josephine A. Kaspar, executrix of said Arthur H. Kaspar, deceased; Don G. Kaspar, executor of said Arthur H. Kaspar, deceased

[73] Assignee: Kaspar Wire Works, Inc., Shiner, Tex.

[21] Appl. No.: 288,793

[22] Filed: Jul. 31, 1981

[51] Int. Cl.[3] ..... G07F 7/06

[52] U.S. Cl. ..... 194/4 D; 194/101

[58] Field of Search ..... 194/4 R, 4 B, 4 C, 4 D, 194/4 E, 4 F, 4 G, 101; 100/902; 209/567, 570

[56] References Cited

U.S. PATENT DOCUMENTS

| | | | |
|---|---|---|---|
| 1,866,716 | 7/1932 | McCormick et al. | 194/4 C |
| 2,628,698 | 2/1953 | Parrish | 194/101 X |
| 2,911,083 | 11/1959 | Hensley | 194/4 R |
| 3,412,837 | 11/1968 | Myers | 194/4 R |
| 4,132,303 | 1/1979 | Stampleman | 194/4 F |
| 4,216,713 | 8/1980 | Jung | 209/567 X |
| 4,245,731 | 1/1981 | Herbst et al. | 194/4 C |
| 4,342,385 | 8/1982 | Kaspar | 133/5 R X |

*Primary Examiner*—F. J. Bartuska

*Attorney, Agent, or Firm*—Gunn, Lee & Jackson

[57] ABSTRACT

A manually operated machine for dispensing coins in exchange for deposit of aluminum beverage cans is shown. An opening in a housing to a rotatable carriage may receive a beverage can which is then rotated through various dimension checking arms that insure the article deposited is a beverage can of the proper dimensions. Stops are provided that will prevent rotation of the carriage if the dimensions are not correct, or if a magnetic detector determines the can is ferrous rather than aluminum. After rotation through the stops, the beverage can is dropped from the rotating carriage into a suitable receptacle. Simultaneous with acceptance of the beverage can, a coin is dispensed. Anti-milking stops prevent more than one coin from being dispersed per beverage can accepted.

6 Claims, 17 Drawing Figures

COIN DISPENSING MACHINE FOR NON-FERROUS BEVERAGE CANS

BACKGROUND OF THE INVENTION

This applicaion is related to U.S. patent application Ser. No. 104,544 filed Dec. 17, 1979 now U.S. Pat. No. 4,342,385 entitled "Article Actuated Coin Dispensing Machine," which has one of the co-inventors of the present application as the sole inventor of the earlier application, the earlier application being incorporated herein by reference.

This invention relates to the recycling of beverage cans and, more particularly, to a machine designed to return coins to persons depositing such cans. The machine would check the beverage can to make sure a deposit should be paid for it, drop the beverage can in a storage bin, and pay the individual his mandatory deposit fee. The checks would include determining if the beverage can was ferrous and, if so, reject the beverage can.

BRIEF DESCRIPTION OF THE PRIOR ART

While coin actuated article dispensing machines abound, there are few beverage can actuated coin dispensing machines. Machines which give coins in exchange for paper money are not relevant because the checks performed are not similar to those needed for checking used containers.

Henry Stapleman (U.S. Pat. No. 4,132,303), "Article Actuated Coin Dispensing Closure For Article Collecting Receptacles," is directed toward a similar goal, but has completely dissimilar functions and mechanisms.

Myers (U.S. Pat. No. 3,412,837) shows a device for separating ferrous and non-ferrous beverage containers, crushing the containers, and storing them in a bin. Myers utilizes a magnetic device, which retains magnetic containers in position along a conveying mechanism to prevent the magnetic containers from being fed to a crusher for aluminum cans. A token is dispensed in response to the cans inserted into the apparatus. The apparatus as shown in Myers is a very complicated device involving motors, chains, pulleys and electronic controls, which result in an apparatus considerably more complex than the simple, hand operated machine of the present invention.

Hensley (U.S. Pat. No. 2,911,083) is a hand operated rotatable drum depository for articles of clothing. Once the articles of clothing have been deposited and the drum rotated to deposit the clothes in a lower receptacle, a deposit receipt is given to the individual. Hensley does not have the numerous checks that are contained in the preset invention, including determination of size and whether or not the item deposited is or is not magnetic. Because Hensley does not have the checks as included in the present invention, it is unsatisfactory for use in dispensing coins in response to the deposit of beverage cans therein.

McCormick, et al. (U.S. Pat. No. 1,866,716) is a machine designed for dispensing of coins in turn for redeeming empty bottles. The device as shown in McCormick is structurally quite different from the present invention and specifically does not include a means for determining if the item being redeemed is ferrous or non-ferrous.

Other article inspection type machines, such as quality control type machines, are available in different lines of commerce. These machines are not, however, well adapted for simple and reliable checking of beverage cans in the manner desired. Furthermore, they are not designed to defeat operator attempts to cheat or to milk the machine.

SUMMARY OF THE INVENTION

The invention checks various dimensions of a beverage can while the beverage can is rotated within a drum. The rotational force is applied through a handle and lever turned by the individual who has deposited the beverage can. Because the depositor can be relied upon to apply a relatively large amount of force, check devices which apply pressure to the beverage can may be utilized. One of the first checks in a magnet that actuates a check device to stop rotation of a drum carrying the beverage can if the beverage can is ferrous, such as the steel can currently on the market. Furthermore, use of a rotary type drum greatly simplifies placement of the necessary internal stops and anti-milking devices.

It is an object of the present invention to provide a machine capable of checking various dimensions of beverage cans or other articles.

It is another object of the present invention to provide a beverage can checking machine which may be manually operated.

It is yet another object of the present invention to provide a machine which does not rely upon the weight of the beverage can checked for the energy to activate a coin dispenser.

It is yet another object of the present invention to provide a device capable of being operated by untrained individuals to return tokens or coins in exchange for deposited beverage cans.

It is yet another object of the present invention that the machine contain sufficient anti-milking and anti-cheating barriers to deter most attempts to milk or cheat the machine.

It is yet another object of the present invention to produce a coin dispenser means which is self-fed and which is designed to be jam proof.

It is still another object of the present invention to provide a machine capable of checking articles deposited to insure that it has the same dimensions as beverage cans and also to insure that the beverage can is non-ferrous.

It is also an object of the present invention to provide a magnetic detection device which is utilized to actuate a stop whenever a ferrous beverage can is inserted in a rotatable drum member of the present invention and rotated in the manner that would normally be used for an aluminum beverage can to obtain a coin from the coin dispenser.

Upon insertion of a steel beverage can into the opening of the drum member of the present invention and rotating the steel can past the magnetic device, the magnetic device will move forward toward the beverage can. The movement of the magnetic device actuates a stop on a rotatable disk which rotates on a main shaft simultaneous with the drum. Thereafter, the only direction the main shaft can be turned by the operator of the machine would be back to the start position. An ejection mechanism may be pulled forward to eject the steel beverage can from the opening to thereafter allow other beverage cans to be inserted, and if non-ferrous, accept it in exchange for a coin or token. Stabilizing attachments may also be connected to the upper portion of the coin tube.

DESCRIPTION OF THE PREFERRED EMBODIMENT

While the preferred embodiment described herein is the current best mode of the invention, it is not the only embodiment contemplated and is not intended as a limitation upon the invention as expressed in the claims.

Figure 1:
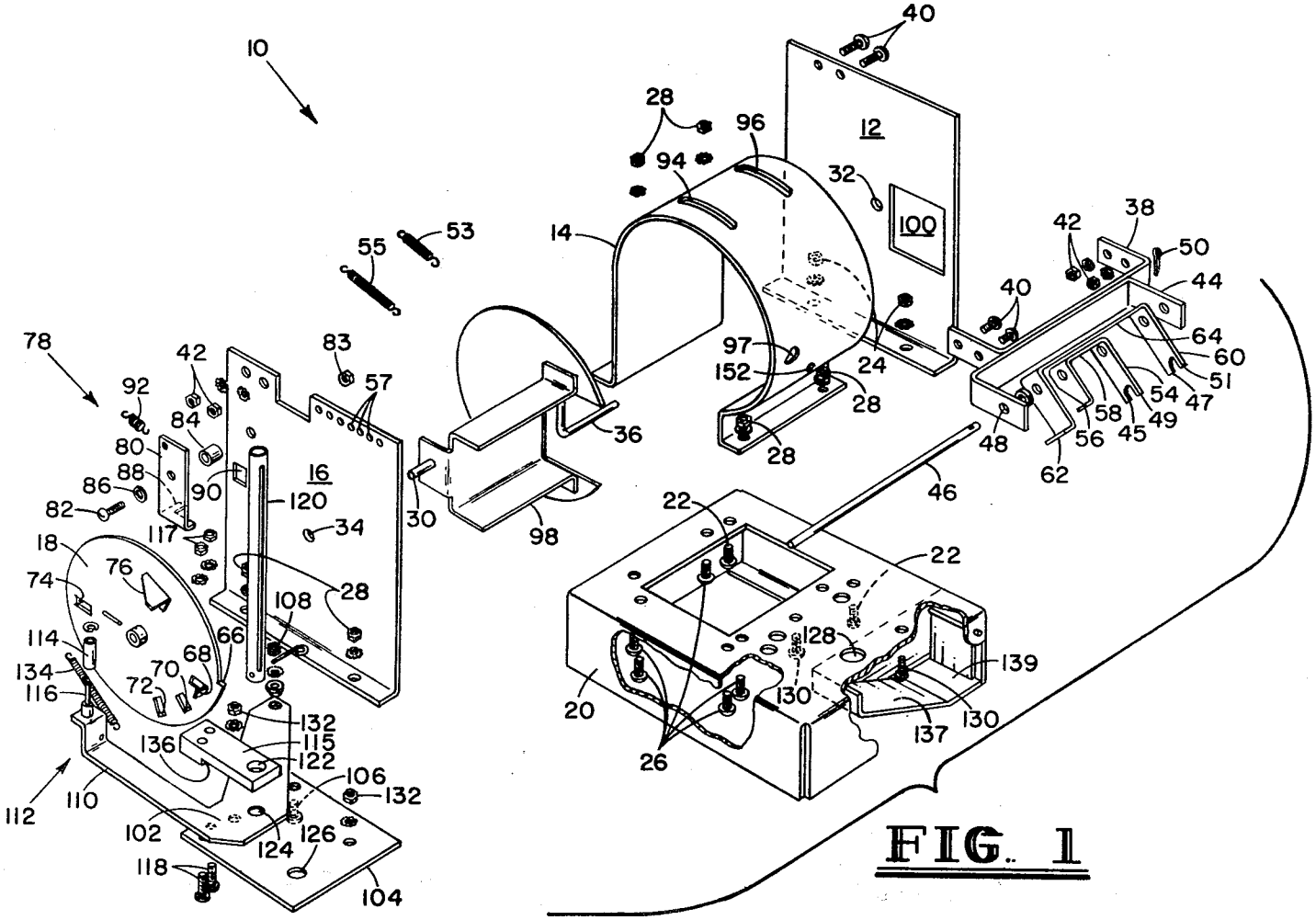
FIG. 1 is a perspective disassembled view of the invention.
Figure 5:
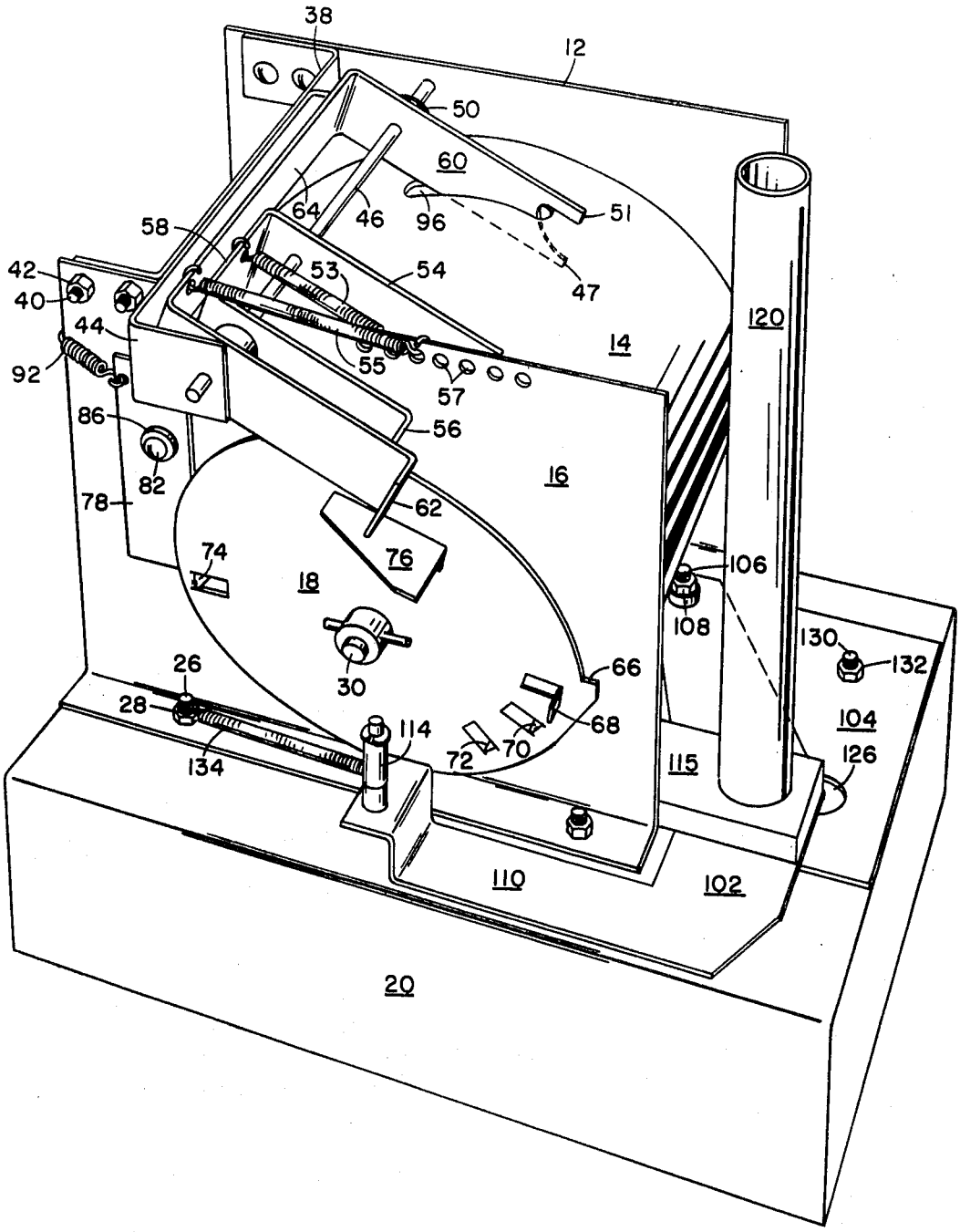
FIG. 5 is an elevated view of the rear of the invention.

FIG. 1 and FIG. 5 show the major components of the machine 10: the front housing 12, the drum 14, the rear housing 16, the disc 18, and the base 20. The front housing 12 is attached to the base 20 by bolts 22 inserted through the front housing 12 and the base 22 and fixed by nuts 24. The drum 14 and rear housing 16 are likewise fastened upon the base 20 by means of bolts 26 and nuts 28.

The main shaft 30 is located longitudinally through the drum 14 and is supported by front and rear housing shaft holes 32 and 34. A handle 36 fixed upon the forward end of the main shaft 30 enables an operator to rotate the main shaft 30. The rear end of the main shaft 30 projects through the rear housing shaft hole 34 and the disc 18 is attached thereto.

Figure 2:
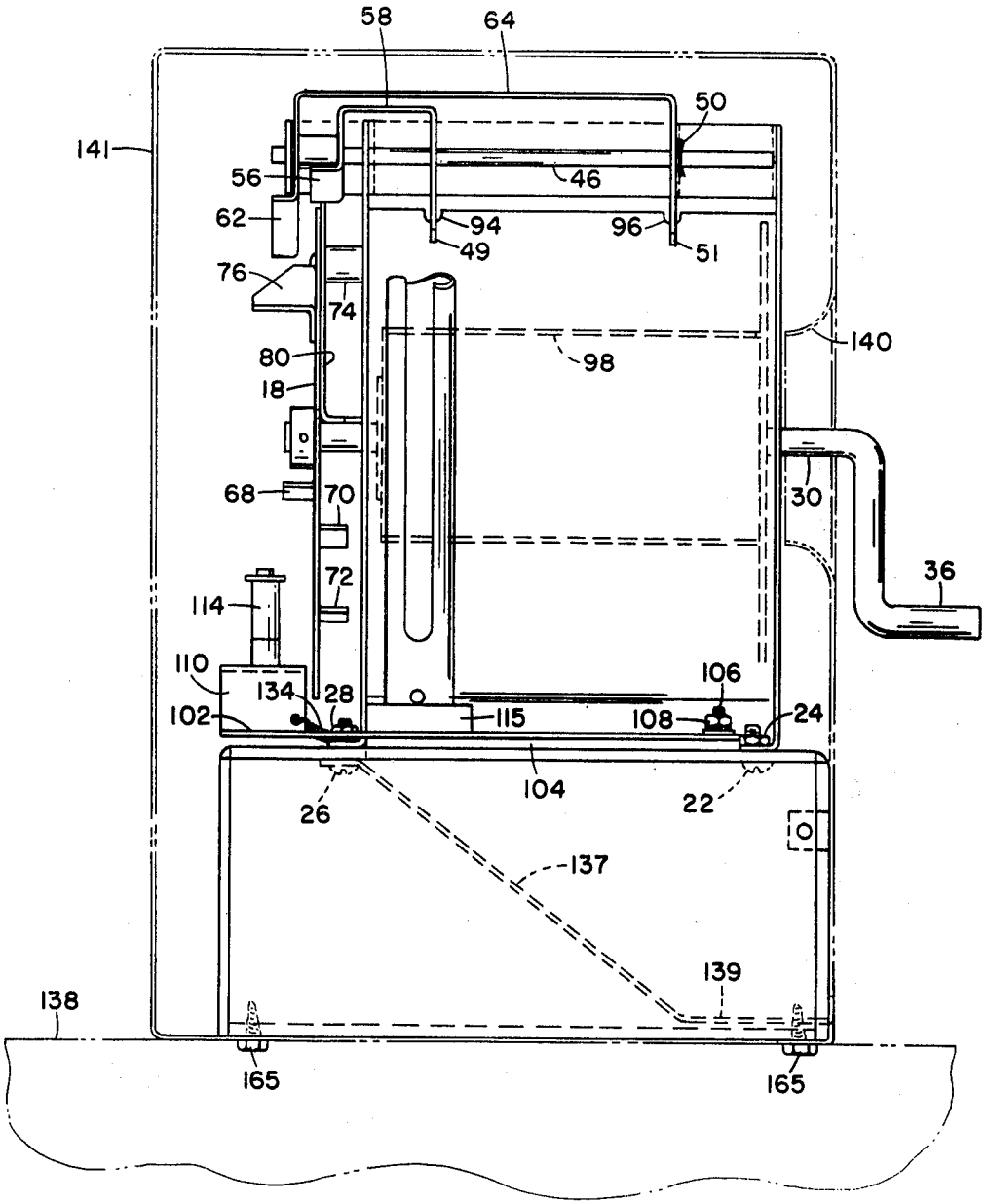
FIG. 2 is a side view of the invention in an assembled form showing the carriage in relief.
Figure 6:
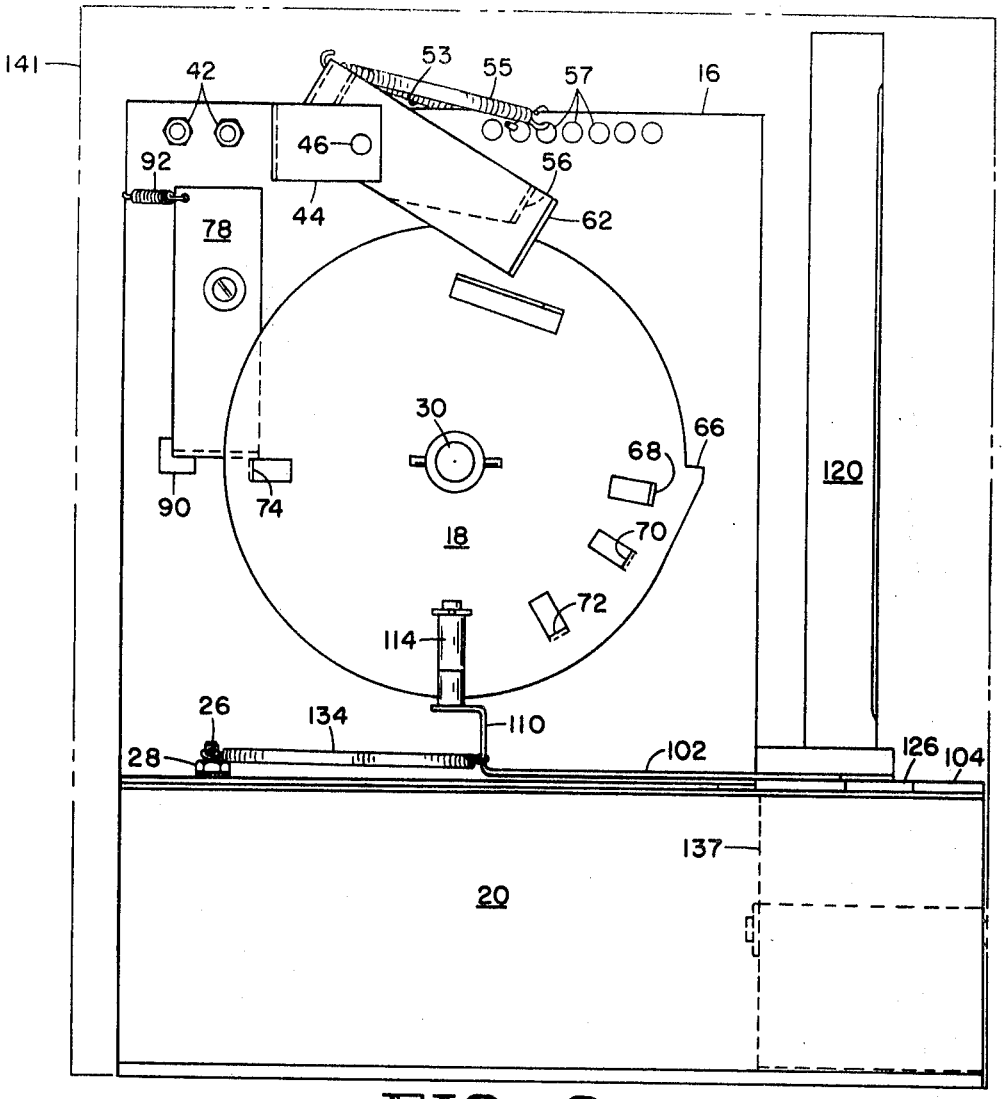
FIG. 6 is an end view of the invention showing the coin dispenser in conjunction with the second disc and a coin access slot in relief.

Located on top of the drum 14, an upper brace 38 is attached to the front and rear housings 12 and 16 by means of bolts 40 and nuts 42. A lock-out bracket 44 is fastened upon the upper brace 38 as shown in FIG. 5. The lock-out bracket 44 accommodates the lock-out shaft 46 through holes 48 and a pin 50 maintains the lock-out shaft 46 in the position as shown in FIG. 2. The first check lever 54 and first lock-out arm 56 are fashioned from a single first bar means 58 and the second check lever 60 and second lock-out arm 62 are fashioned from a single second bar means 64. Both first and second bar means 58 and 64 are rotatively retained by lock-out shaft 46. The test ends of the first and second check levers 54 and 60 consist of spikes 45 and 47 and upper supports 49 and 51, respectively. A spring 53 is attached to the first bar means 56 and a spring 55 attached to the second bar means 64. The springs 53 and 55 are also attached to one of the adjuster holes 57 located upon the rear housing 16 and serve to force the levers 54 and 60 downward through slots 94 and 96 to within the drum 14.

The disc 18 contains a lock-out notch 66 and a lock-out stop 68. First disc arm 70, second disc arm 72, and third disc arm 74 are located upon the forward face of the disc 18. The trigger activator 76 projects from the rear of the disc 18.

A reverse lock-out 78 consisting of an arm 80, upon a bolt 82, a nut 83, and a bushing 84 and held by a washer 86, is located upon the rear housing 16. The projection of a stop 88 upon the arm 80 within rear housing slot 90 limits the rotation of the reverse lock-out 78 as caused by spring 92.

First and second lock-out slots 94 and 96 are cut within the upper surface of the drum 14 such that first and second check levers 54 and 60 may fit within them as shown in FIG. 5. Additionally, an unjamming slot 97 is cut within a side of the drum to allow a caretaker to unjam articles caught upon the carriage 98.

Figure 3:
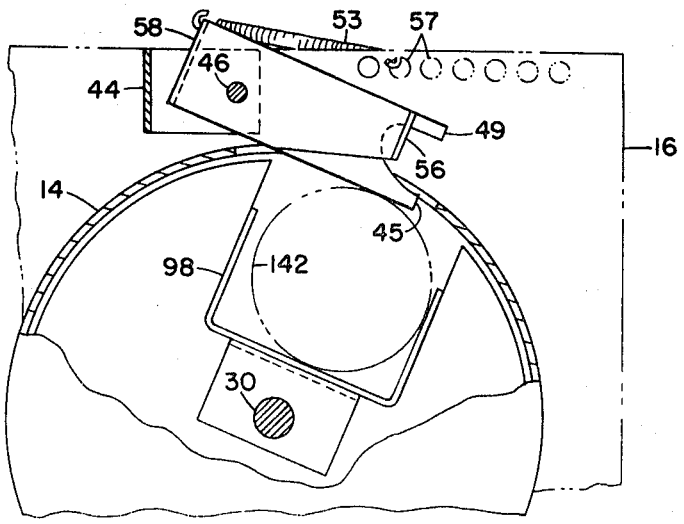
FIG. 3 is a partial cut-away view of the invention showing a check lever checking a beverage can carried upon the carriage.
Figure 4A:
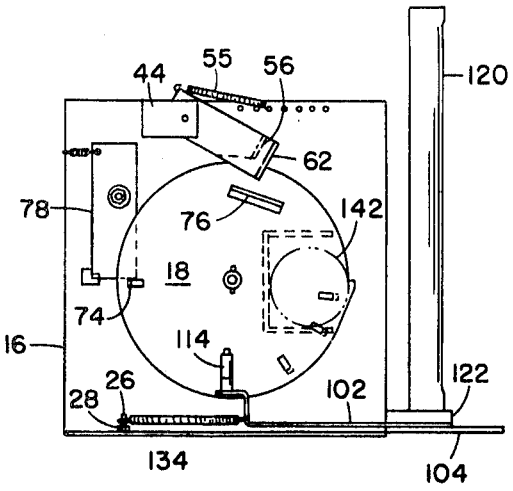
FIGS. 4(*a*), 4(*b*), 4(*c*), 4(*d*), 4(*e*), and 4(*f*) sequentially show the relative positions of the disc, a lock-out arm, a check lever, the trigger actuator and the trigger, and additionally showing in relief the relative positions of the carriage and article during the article acceptance process to determine if it is a beverage can.
Figure 4B:
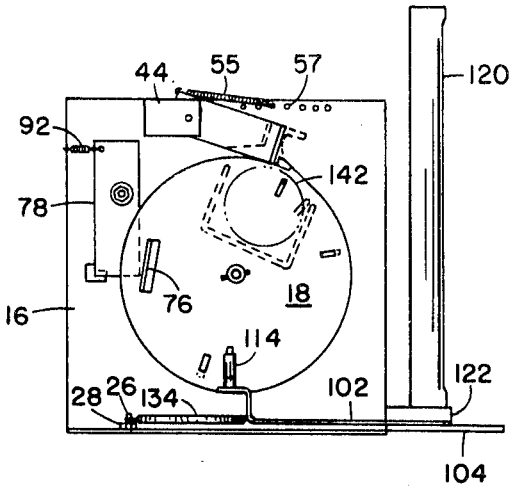
Figure 4C:
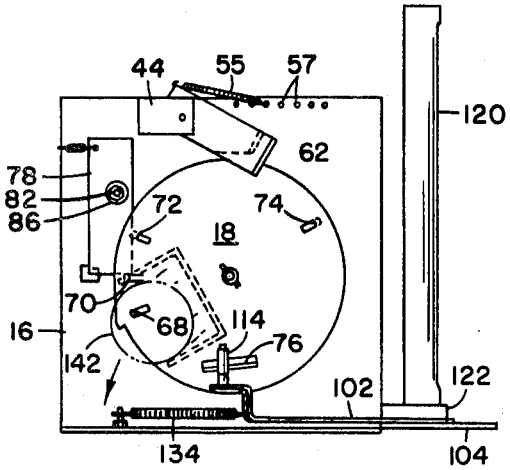
Figure 4D:
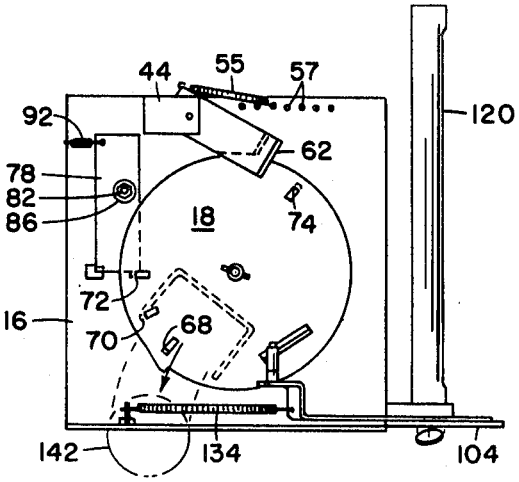
Figure 4E:
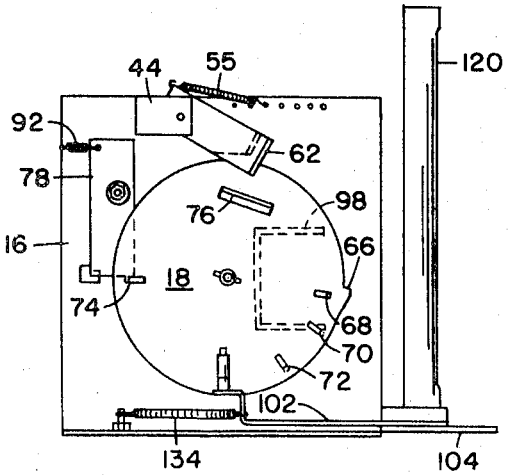
Figure 4F:
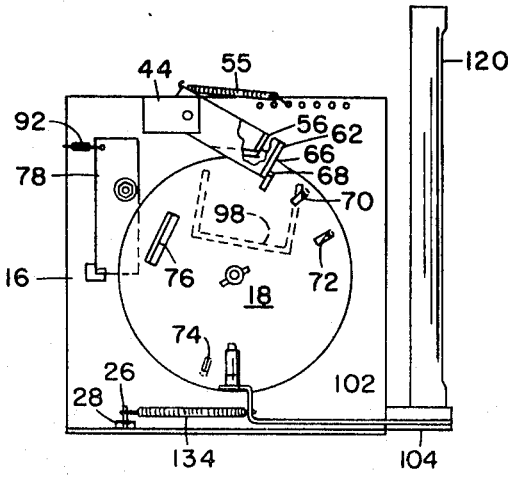

Carriage 98 is located within the drum 14 and upon the main shaft 30 as shown in FIG. 3. An opening 100 to allow for insertion of an article, such as a beverage can, upon the carriage 98 is found within the front housing 12 as shown in FIG. 1.

The thickness of coin eject plate 102 is approximately the same as the thickness of the denomination coin intended to be used with the coin eject plate 102 and it is rotatively attached to coin eject base 104 by means of bolt 106 and nut 108. The coin eject arm 110 supports a trigger 112 consisting of a bushing 114 aupon pin 116. The trigger 112 lies in the path of the trigger actuator 76. The trigger actuator 76 therefore forces the coin eject plate 102 to move away from the disc 18 upon clockwise rotation of the trigger activator 76 against the trigger 112.

Coin tube holder 115 is fixed upon the coin eject base 104 by nuts 117 and bolts 118. The outer surface of the lower end of the coin tube 120 is sized to fit within the hole 122 in the coin tube holder 115 without slipping through it. The coin tube holder hole 122, the coin eject plate hole 124, the coin eject base hole 126, and the base coin hole 128 are all sized to be larger than the size coin they are expected to accommodate. The coin eject base 104 is fixed upon the base 20 by bolts 130 and nuts 132. A spring 134 attached to the coin eject arm 110 and bolt 26 operates to pull the coin eject plate 102 flush against the lower face of the coin holder 136 absent any force applied by the trigger actuator 76. A coin chute 137 sloping downward toward a coin access 139 is located below the base coin hole 128.

Figure 8:
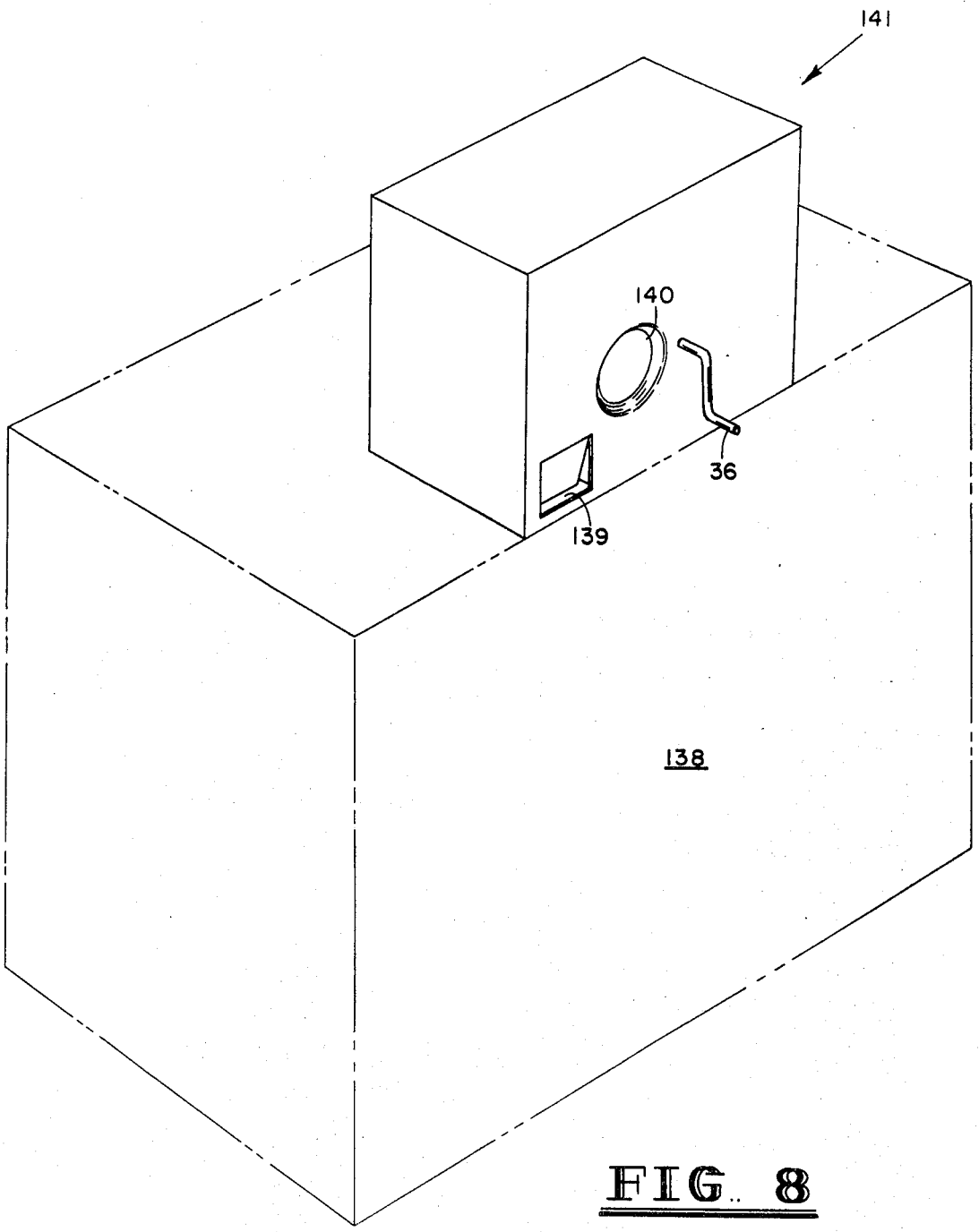
FIG. 8 is an elevated view of the coin dispensing machine for beverage cans retained within a protective display and situated upon a large container for accepted beverage cans.

The machine 10 is typically mounted within protective display 141 attached by bolts 165 to a large container 138 for storing received articles as shown in FIGS. 2 and 8. A beverage can sized input hole 140 allows access to the machine 10.

In operation, the operator inserts the beverage can to be checked 142 through the input hole 140 and through plate 200 has the coin eject base 104, coin eject plate 102, coin tube holder 115 mounted thereon for operation by the coin eject arm 110 when moved along with bushing 114 by the trigger actuator 76 (not shown in FIG. 9) as it rotates by bushing 114. The position of the disc 18 is the same as the position shown in FIGS. 2, 4(*a*), 5 and 6 of the drawings.

Figure 9:
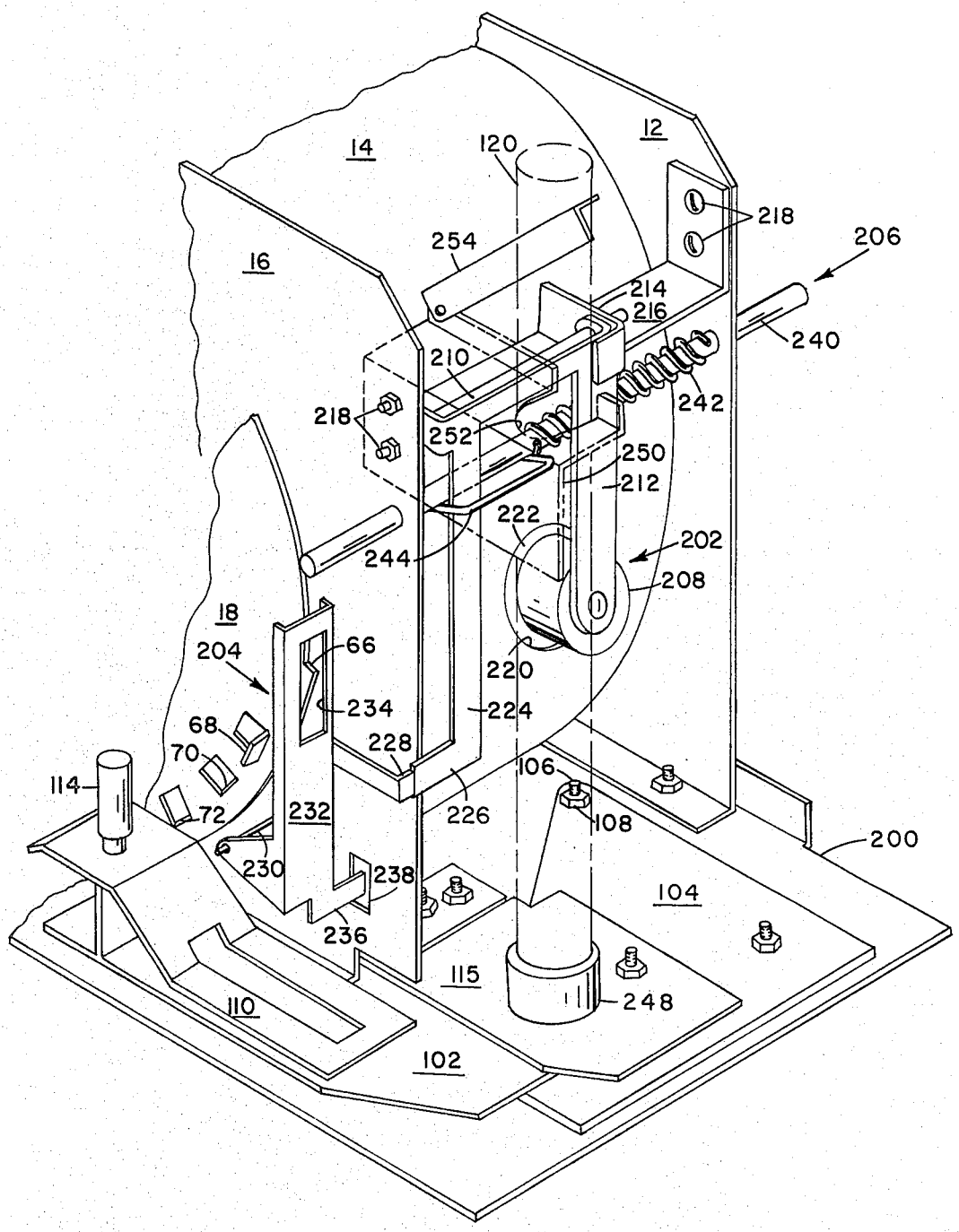
FIG. 9 is a partial perspective view of an alternative embodiment of the present invention illustrating a magnetic detection device with a metallic stop device and a metallic ejection device.
Figure 10:
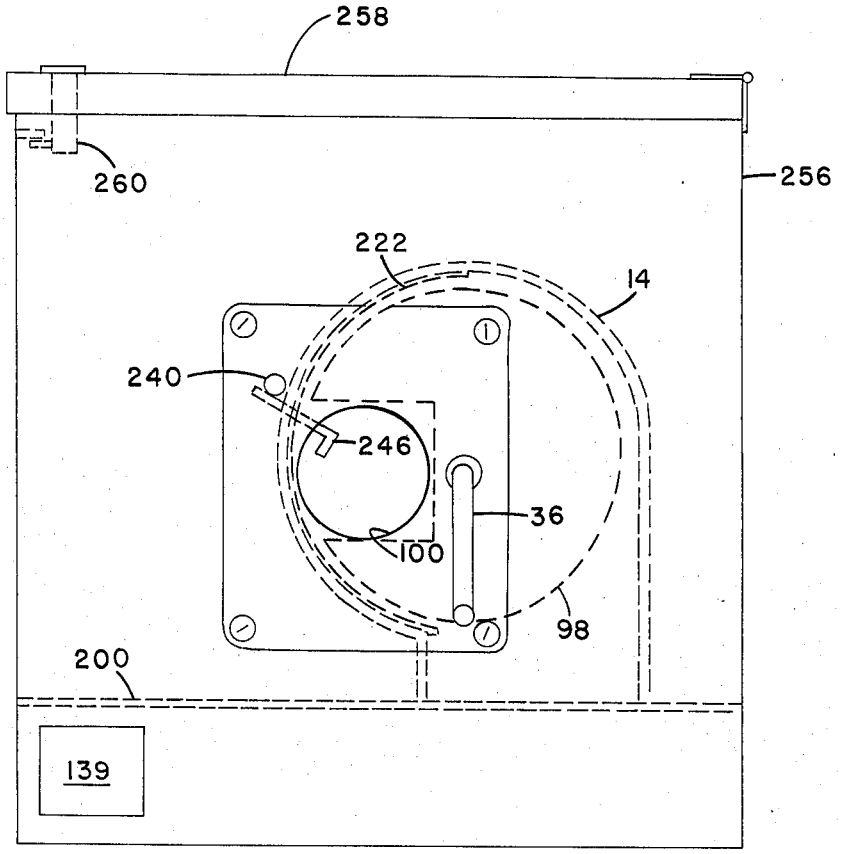
FIG. 10 is a front view of an embodiment of the present invention as assembled in a housing, which embodiment has the alternative features shown in FIG. 9.

Added to the embodiment as shown in FIGS. 9 and 10, is a magnetic detector represented generally by reference numeral 202, which is used to operate a mechanical stop 204 and a can eject mechanism 206. The magnetic detector 202 includes a permanent magnet 208 pivotally mounted on pin 210 by a pivotal mounting strap 212. The pin 210 is held in position by a support bracket 214 mounted on cross-bracket 216. Cross-bracket 216 is mounted on each end thereof to front housing 12 and rear housing 16 by any suitable means, such as bolts 218.

Located immediately adjacent one end of the permanent magnet 208 is an opening 220 in the drum 14. However, inside of the drum 14 is a non-magnetic strip of material 222 which covers opening 220. The non-magnetic material 222 can best be seen in FIG. 10 in reference lines. The purpose of the non-magnetic material 222 is simply to cover opening 220 so that the permanent magnet 208 will not contact a ferrous can, such as steel, if inserted in the present machine. The opening 220 also prevents the magnet 208 from coming in contact with the drum 14, which normally would be made from a magnetic material.

The pivotal mounting strap 212 also has a stop actuating arm 224 formed integral therewith. By rotation of a steel beverage can in front of the permanent magnet 208, the permanent magnet 208 moves inward until it hits the non-magnetic material 222. This causes the pivotal mounting strap 212 to pivot on pin 210 and to simultaneously pivot inward the stop actuating arm 224. Moving of the stop actuating arm 224 inward causes an actuating tab 226 of stop actuating arm 224 to press against stop tab 228 of mechanical stop 204. The mechanical stop 204 is pivotally mounted on pin 230, which is carried by rear housing 16. The mechanical stop 204 includes a vertical member 232 with an upper slot opening 234 contained therein. The vertical member 232 is formed integral with the stop tab 228, therefore, when stop tab 228 is pressed inward by actuating tab 226, the vertical member 232 pivots toward the disc 18. By pivoting the vertical member 232 toward the disc 18, lock-out notch 66 catches inside of upper slot 234 preventing further rotation of the disc 18 and the carriage 98 attached thereto.

A lower tab 236 extends into an opening 238 of the rear housing 16, which lower tab 236 prevents the mechanical stop 204 from pivoting outward too far away from the disc 18. However, the opening 238 is large enough to allow pivotal movement of lower tab 236 toward disc 18 before the upper slot 234 engages lock-out notch 66.

Assuming a steel beverage can is inserted in the machine 10 through opening 100 (see FIG. 10), upon rotation of the carriage 98, the steel can passes adjacent the permanent magnet 208 which moves inward thereby pivoting the pivotal mounting strap 212 which moves the actuating arm 224. The actuating arm 224 in turn moves the stop mechanism 204, which causes the slot 234 to move inward against the disc 18. The lock-out notch 66 will then engage the upper portion of the slot 234 to prevent the steel beverage can from being accepted.

To eject the beverage can from the carriage 98 through opening 100, can eject mechanism 206 consists of a spring loaded shaft 240 mounted between rear housing 16 and front housing 12. The spring 242 continually urges spring loaded shaft 240 toward the rear housing 16. Attached to the spring loaded shaft 240 is an eject rod 244 that has end 246 extending inside of the drum 14 as can be clearly seen in FIG. 10. By pulling on the spring loaded shaft 240, end 246 of eject rod 244 pushes the steel beverage can out through opening 100.

To insure the stability of the coin tube 120, a lower cylinder 248 is attached to the coin tube holder 115 and receives the coin tube 120 therein. The upper portion of the coin tube 120 may be contained inside of a bracket 250 (shown in reference lines to prevent blocking of the view of other component parts), which has a slot 252 for receiving the coin tube 120 therein. Bracket 254 may be pivotally mounted to bracket 250 for closing the slot 252 and retaining the coin tube 120. Bracket 250 is connected to rear housing 16 by any suitable means, such as bolts 218.

In FIG. 10, the entire machine as previously described in conjunction with FIG. 9 may be contained inside of housing 256. The mounting plate 200 is mounted to the housing 256 and has the coin access 139 formed integral with the housing 256. An upper lid 258 of the housing 256 allows access to the machine by means of a key lock 260. This provides the security necessary to prevent someone from stealing coins from the machine. The entire housing 256 is then mounted on top of a receptacle for receiving the beverage cans therein.

We claim:

1. A machine for dispensing coins in response to receipt and checking of non-ferrous cans comprising:

housing having a can opening from outside said housing to inside said housing to receive said non-ferrous cans therethrough;

cylinder means rotatably carried in said housing on a shaft means extending from said housing to form a handle, said cylinder means having a carriage for receiving said non-ferrous can through said can opening and rotating said non-ferrous can therewith via said handle;

check means for checking said non-ferrous can during rotation of said cylinder means to insure defined characteristics of said non-ferrous can;

plate means rotated by said shaft means, said plate means engaging said check means to stop rotation of said cylinder means if said defined characteristics are not met;

magnetic means pivotally mounted on said housing adjacent said cylinder means, said magnetic means checking articles inserted in said can opening and rotated adjacent thereto to determine if said article is ferrous and if so moving said magnetic means toward said article;

a partial shell around said cylinder means, said partial shell having a non-metallic sheet between said magnetic means and said cylinder means;

linkage means operatively connecting said magnetic means through said pivotal amount of said magnetic means to said plate means to prevent said rotation of said plate means and said cylinder means if said article is ferrous;

the opening 100 and onto the carriage 98. FIG. 4(*a*) shows an end view of this position.

The operator rotates the handle 36, the main shaft 30, and all parts connected to it in a counterclockwise direction. (For the purpose of clarity, the directions of the rotation will be described throughout from the perspective of an individual standing behind the machine 10. It is understood that an identical but symmetrically opposite machine is necessarily included for all purposes.) As is shown in FIG. 4(*a*), reverse lock-out 78 fits against the third disc arm 74 to prevent the operator from rotating a beverage can 142 in a clockwise direction in an attempt to "milk" the machine 10.

After rotating the beverage can 142 from in front of the opening 100 to approximately a 1:00 o'clock position, the beverage can 142 is positioned to be checked as is shown in FIGS. 3 and 4(*b*). The spikes 45 and 47, when combined with the action of springs 53 and 55, push against the outer surface of the beverage can 142 with a predetermined amount of pressure. If the beverage can 142 (or other article) is not strong enough to force both check levers 54 and 60 up, the lock-out arms 56 and 62 block further rotation. Further, if the article surface is not stiff enough to avoid puncture by either spike 45 or 47, or if the surface is not smooth enough to permit them to slide across it, the article will jam against them. The angle of incidence and sharpness of the spikes 45 and 47 may be varied and the amount of pressure exerted by them varied by moving springs 53 and 55 along the adjuster holes 57. These tests are to insure the article is a beverage can, such as beverage can 142.

If check levers 54 and 60 are forced upward by the beverage can 142, bar means 58 and 64 are rotated about the lock-out shaft 124, and the lock-out arms 56 and 62 lifted from their original positions and no longer jam against the disc lock-out notch 66 or lock-out stop 68 to prevent further counterclockwise rotation.

Figure 7A:
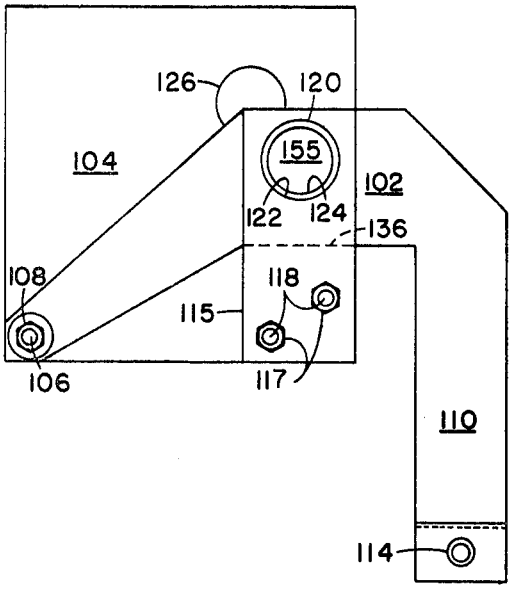
FIG. 7(*a*), 7(*b*), and 7(*c*) sequentially show vertical views of the coin dispenser for the different possible positions of the coin eject plate.
Figure 7B:
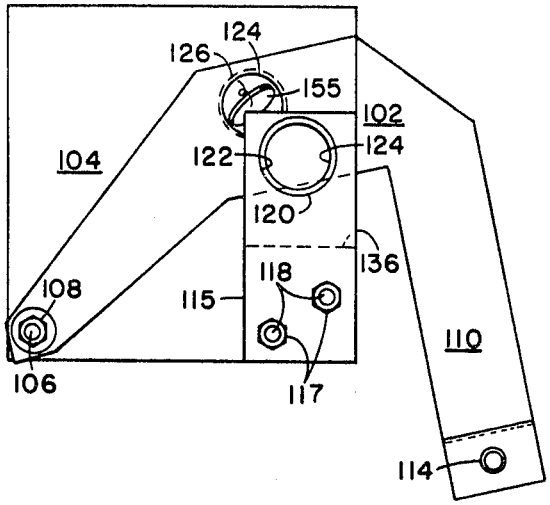
Figure 7C:
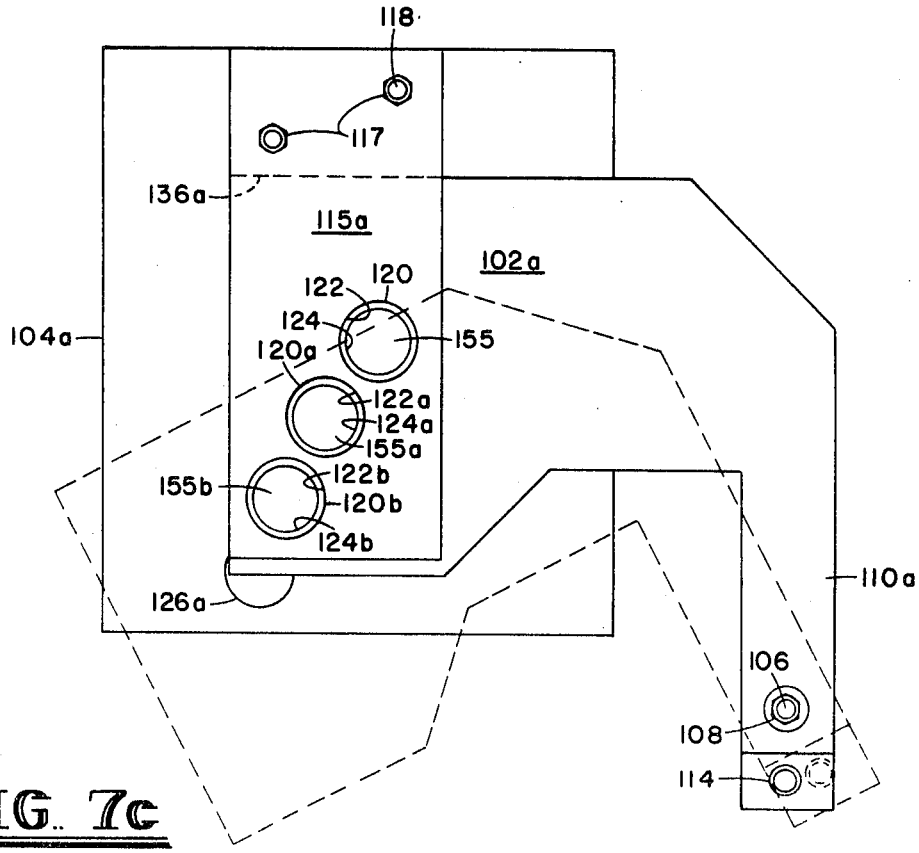

Upon further counterclockwise rotation of the beverage can 142 to an approximate 9:00 o'clock position, the first disc arm 72 contacts and outwardly displaces the reverse lock-out 78 and the outer sloped edge of the trigger actuator 76 contacts and begins to displace the trigger 112. At the 8:00 o'clock position, the first disc arm 72 moves beyond the reverse lock-out 78 and reverse lock-out 78 returns to its normal position thus blocking any clockwise motion. At the 7:00 o'clock position, the trigger 112 and coin eject plate 102 are so far rotated about bolt 106 as shown in FIG. 7(*b*) that the coin within coin eject plate hole 124 falls through the coin eject base 104, down the coin chute 137, and to the coin access 139. Attempts by the operator to cheat the machine by returning for other coins by clockwise rotation is impossible because of the interference of the reverse lock-out 78 with the first disc stop 70. Any further counterclockwise rotation moves the second disc stop 72 past the reverse lock-out 78 and the trigger actuator 76 past the trigger 112 allowing spring 134 to return the coin eject plate 102 to its original position flush against the lower face of the con tube holder 136 as shown in FIG. 7(*a*) and where another coin falls from the coin tube 120 into the coin eject plate hole 124. The beverage can 142 simultaneously falls from the carriage 98 into the storage area 138 of the protective display 141 as shown in FIG. 4(*d*).

FIG. 4(*f*) shows lock-out arms 56 and 62 abutting against lock-out notch 66 and lock-out stop 68, respectively, in the case of an attempt to cheat the machine by rotating the shaft 30 in a counterclockwise direction without placing a beverage can 142 or a satisfactorily sized article within the carriage 98.

FIG. 7(*c*) shows a method of using multiple coin tubes 120, 120(*a*), and 120(*b*) to increase the coin storage capacity of the machine 10. The additional tubes 120(*a*) and 120(*b*) are located upon the coin eject plate hole 124 arc. Coin eject plate 102(*a*) is sufficiently large enough to remain under all coin tubes 120, 120(*a*) and 120(*b*) at all times. If the coin eject plate hole 124 is empty when it passes beneath a coin tube containing coins, a coin will drop into the coin eject plate hole 124. If the coin tube is empty or if a coin is already within the coin eject plate hole 124, the hole 124 will pass beneath the coin tube without effect.

An additional means of assuring that beverage can 142 drops from the carriage 98 is utilization of a stripper bolt fastened (not shown) upon the inside of the drum 14 in stripper bolt hole 152. The striper bolt projects into the carriage 98 and prevents further counterclockwise rotation until the beverage can 142 falls from the carriage 98. This is necessary to avoid attempts to cheat the machine by affixing the beverage can 142 deposited within the carriage 98. Further, the machine 10 has been designed so that its moving parts are located upon the outside of the drum 14 and are thus easily accessible for inspection and repair.

It is additionally contemplated that the machine may be designed and constructed to be operable in a nonrotary or a linear fashion. In these alternative versions of the invention, similar openings, checks, and stops are used as are described in the rotary version above. Location of these elements to effectively function in nonrotary or linear versions of the invention will be apparent to those who read the above description and are skilled in the art.

It is thus seen that eight separate and cooperating checks are performed upon the beverage can 142 prior to the operator receiving a coin 155 to insure the article deposited is a beverage can. If an article will not fit between the front rear housings 12 and 16, it is too long. If it will not fit through the opening 100, it is too wide. If it is not long enough to lift both check levers 54 and 60 simultaneously, it is too short. If it is not wide enough to repel the spikes 45 and 47, if the overall article is insufficiently strong to resist crushing by the check levers 54 and 60, or if the surface is too rough to permit spikes 45 and 47 to slide over it under pressure, the article will not be accepted for payment. Springs 53 and 55 may be varied in tension, the spikes 45 and 47 varied in sharpness, and the number, reach, and lateral placement of the check levers 54 and 60 varied as may be deemed practicable.

A manually operated coin dispensing machine for beverage cans checking eight article characteristics, having anti-milking functions, and having a coin dispenser as an integral part thereof has been shown. While the invention has been described in connection with the preferred embodiment, it is not intended to limit the invention to the particular forms set forth, but, on the contrary, it is intended to cover such alternatives, modifications, and equivalents as may be included within the spirit and scope of the invention.

Referring now to FIGS. 9 and 10 in combination, an alternative embodiment of the present invention is shown. The base 20 of the prior Figures is shown in a box-like configuration; however, in FIGS. 9 and 10, the base 20 is replaced with a mounting plate 200, which can be seen in reference lines in FIG. 10. Mounting coin dispensing means operated by rotation of said shaft for dispensing said coins upon a substantially complete rotation of said cylinder means; and can receiving means operated by rotation of said shaft receiving said non-ferrous can upon a substantially complete rotation of said cylinder means.

2. The machine for dispensing coins in response to receipt and checking of non-ferrous cans as given in claim 1 further comprising ejection means slidably mounted in said housing adjacent said can opening, said ejection means extending from a front of said housing for pulling to remove ferrous cans from said carriage, said ejection means including means for returning said ejection means to a start position.

3. The machine for dispensing coins in response to receipt and checking of non-ferrous cans as given in claim 1 or 2 wherein said linkage means comprises pivot means mounted on said housing for pivotally carrying a support means with a first arm connected to said magnetic means and pivoting therewith, a second arm of said support means causing interference with rotation of said plate means upon movement of said support means by said magnetic means.

4. The machine for dispensing coins in response to receipt and checking of non-ferrous cans as given in claim 3 comprising a mechanical stop pivotally mounted on said housing and abutting said second arm, said mechanical stop being adjacent said plate means to interfere with rotation thereof only upon pivoting of said support means by said magnetic means due to pushing by said second arm.

5. The machine for dispensing coins in response to receipt and checking of non-ferrous cans as given in claim 1 wherein said partial shell is generally cylindrical and magnetic with a magnet opening therein adjacent said magnetic means, said opening being covered by said non-magnetic sheet.

6. The machine for dispensing coins in response to receipt and checking of non-ferrous cans as given in claim 5 wherein said magnetic means is a permanent magnet mount on said linkage means, said permanent magnet being drawn against said non-magnetic sheet if an article in said carriage rotated adjacent thereto is ferrous.

* * * * *